US009489931B2

(12) United States Patent
McDaniel

(10) Patent No.: US 9,489,931 B2
(45) Date of Patent: Nov. 8, 2016

(54) MUSICAL DRUM WITH REMOVABLE SNARE ASSEMBLY

(71) Applicant: Michael D. McDaniel, Lake Hughes, CA (US)

(72) Inventor: Michael D. McDaniel, Lake Hughes, CA (US)

(73) Assignee: REMO, INC., Valencia, CA (US)

( * ) Notice: Subject to any disclaimer, the term of this patent is extended or adjusted under 35 U.S.C. 154(b) by 7 days.

(21) Appl. No.: 14/598,158

(22) Filed: Jan. 15, 2015

(65) Prior Publication Data

US 2016/0210942 A1 Jul. 21, 2016

(51) Int. Cl.
*G10D 13/02* (2006.01)

(52) U.S. Cl.
CPC ..... *G10D 13/025* (2013.01)

(58) Field of Classification Search
CPC ..... G10D 13/025
USPC ..... 84/417
See application file for complete search history.

(56) References Cited

U.S. PATENT DOCUMENTS

| | | | | |
|---|---|---|---|---|
| 7,482,522 | B2 | 1/2009 | Wening | |
| 7,485,790 | B2 * | 2/2009 | Payerl | G10D 13/02 84/411 R |
| 7,692,083 | B2 | 4/2010 | Aspland | |
| 7,816,596 | B2 | 10/2010 | Bottger | |
| 9,087,497 | B1 * | 7/2015 | Krol | G10D 13/02 |
| 9,263,010 | B2 * | 2/2016 | Trask | G10D 13/025 |

* cited by examiner

*Primary Examiner* — Jianchun Qin
(74) *Attorney, Agent, or Firm* — Larry F. Gitlin; Beaumont Gitlin Tashjian

(57) ABSTRACT

A housing for a musical instrument having a resonant chamber made from several integrated panel members with at least one snare assembly inside having individual wires having a first end portion connected to a first mounting member releasably supported at a first position and a second end portion connected to a second mounting member releasably supported at a second position. First and second mounting members are disposed to vertically stretch the wires substantially taut in continuous contact relation with the inside surface of one panel member. First and second wedge-shaped support members, which are is secured at the first and second positions, respectively, are spaced apart and have sloping surfaces disposed towards the inside surface of a panel member, and are conformed to receive corresponding first and second mounting members in angular relation.

24 Claims, 18 Drawing Sheets

MUSICAL DRUM WITH REMOVABLE SNARE ASSEMBLY

BACKGROUND OF THE INVENTION

1. Field of the Invention

The present invention relates generally to the field of musical drums and, more particularly, to an improved device that produces and significantly clearer and more concise snare sound coupled with a resonant bass tone. The improved device also enables the convenient and quick removal of a snare assembly from inside the drum's resonant chamber for repair and replacement.

2. Description of the Prior Art

Percussion instruments comprise a wide variety of musical devices well-known in the prior art, including, but not limited to, drums having one or more membranes called drumheads stretched over the end or ends of a hollow cylinder or shell. Sounds are produced by striking the drumhead with a stick, mallet, brush or even the player's hand, or any portion thereof. The sound produced by a drum depends on a variety of factors, including, but not limited to, the shape, size and thickness of the shell, materials from which the shell is fabricated, the material comprising the drumhead and the tensioning of the drumhead.

A typical percussive grouping used by bands and orchestras of all types is the common drumset usually comprised of a bass drum, snare drum, tom-tom and cymbals or any combination of these, most supported by metal stands. Also included with these drumsets are pedals to manipulate the cymbals and a mallet or the like for striking the bass drum. A seat or, in the common parlance of the field, a throne, is also provided.

One musical drum not typically part of a conventional drumset is an instrument commonly known as a cajon, which is a box or cuboid shaped percussion instrument originally from Peru. Because of its ability to produce a multitude of drum sounds by striking one or more sides of the instrument and its portability, the cajon has grown in popularity and can easily, and often does, provide a viable and more cost effective alternative to the drumset.

A typical cajon has a resonant chamber fashioned from a plurality of panels with a vent opening or port formed usually in the back panel for producing bass tones. Within the resonant chamber, attached as an option to the inside surface of the front-facing strike plate or secured adjacent to the inside surface, are metal strings or snares used to produce a snare sound when the front plate is struck. The cajon panels or walls, because they are relatively thin, operate as vibrating membranes serving the same relative function as a conventional drumhead. Striking a cajon panel or strike plate in different places, e.g. at the corners, the high or low sections, the central portion, etc., can thus produce a variety of different and extremely unique and pleasing percussive sounds.

The top panel of a cajon provides a seat for the player to sit upon while striking the instrument. To play the cajon, the player may use his or her hands, fingers, palms, knuckles and fingernails to produce a multitude of sounds. Mallets, brushes and sticks or any other suitable resilient or hard object may also be used for this purpose.

The cajon combines the ability to produce the two most basic drumset sounds in music (i.e. bass and snare) into one instrument. Thus, most issues involved in the playing of a cajon, a single musical instrument, regard chiefly the production of distinct bass and snare sounds, which typically are within the higher frequency range for the bass sounds and the lower frequency range for the snare sounds. These include, among others, the ability to fine tune the snares for a particular kind of music and to achieve the proper balance of bass-to-snare ratio. To accomplish this, the trade-offs are abundant, including the use of expensive snare wires and their oftentimes complicated assemblies. Expensive snare assemblies usually require some type of threaded fastener to create tension in the snare wire with the goal of creating less deflection and producing a more precise sound needed for fast musical passages or stylistic changes. The problem most associated with these types of snare assemblies, aside from the expense, is that the wires normally do not establish the requisite positive continuous contact with the top or bottom portions of the chamber wall or, more specifically, inside surface of the strike plate with which they must interact. Contact limited only to the mid-section, the upper or lower half, or only the very top or bottom of the inside wall is insufficient. Thus, to achieve the desired snare sound where there is no direct contact between the snare wires and the inside wall surface, as aforesaid, the player must alter his or her technique by striking those specific locations with greater force. Unfortunately, this technique introduces undesirable bass tones.

Another trade off is having to incorporate tension screws and similar hardware, which can be complex and otherwise problematic, and result in diminished and distorted sound quality. Resonating musical instruments that include a chamber body will simply not freely resonate and produce the most desirable sounds if assembled with metal screws or any other items, complicated or not, with a metallic composition.

An additional trade-off regards the necessity to remove a portion or even an entire panel from the resonant chamber to access the interior for removal or replacement of all or any portion of the snare assembly.

Many of the advances in cajon technology are disclosed in the following prior art:

U.S. Pat. No. 7,482,522 B2 issued Jan. 27, 2009 to Wening discloses a cajon incorporating a snare carpet that rests against the inside surface of the front panel with the snare carpet actuated by a pedal. Striking the front panel causes the panel to vibrate which, in turn, causes the snare carpet to produce a characteristic snare sound.

U.S. Pat. No. 7,485,790 B2 issued Feb. 3, 2009 to Payerl teaches a cajon made of wooden plates incorporating an apparatus inside the resonant chamber consisting of wires mounted recessed along the chamber's bottom and strung in a predetermined arrangement along with associated damping elements for producing sound effects when any of the wooden plates is struck by an object.

U.S. Pat. No. 7,692,083 B2 issued Apr. 6, 2010 to Aspland teaches a cajon or box drum including a plurality of internal snares which can be compelled to contact one or more of the interior surfaces of the striking plates to produce appropriate snare sounds when the cajon is struck. A bass drum stick or mallet may also be installed inside the resonant chamber for use by the player in selectively striking the instrument to produce unique sounds. An external device, such as a pedal, suitable for operating the bass drum stick may also be provided.

U.S. Pat. No. 7,816,596 B2 issued Oct. 19, 2010 to Bottger teaches a cajon with improvements that include, among others, a strike plate that projects beyond a recess in the housing, a corner enhancement attached to the strike plate as a freely vibrating corner, in one example, consisting of a block and at least one corner structurally separated from the strike plate and attached to a support rail that can cause the corner to vibrate.

However, nothing in the prior art includes the improvement of the present invention, which combines a uniquely constructed releasably retained snare assembly inside the resonant chamber of a musical instrument, in this example, a cajon, with means disposed cooperatively to vertically stretch the snare wires substantially taut in continuous contact relation with the inside surface of the strike plate to produce a significantly clearer and more concise snare sound coupled with a desirable resonant bass tone.

SUMMARY OF THE INVENTION

In its preferred embodiment, the present invention provides a housing for a musical instrument having a resonant chamber fashioned from a plurality of panel members with each of the panel members having a corresponding inside surface and an outside surface. Also included is at least one snare assembly having a plurality of individual wires with each grouping of individual wires having a first end portion and a second end portion. The first end portion is connected to a first mounting member releasably supported at a first position inside the resonant chamber and the second end portion is connected to a second mounting member releasably supported at a second position inside the resonant chamber. First and second mounting members are disposed cooperatively to vertically stretch the individual wires substantially taut in continuous contact relation with the inside surface. A first generally wedge-shaped support member is secured at the first position and a second generally wedge-shaped support member, which is spaced apart from the first wedge-shaped support member, is secured at the second position. The first and second wedge-shaped support members each have sloping surfaces disposed towards the inside surface of a panel member or strike plate, as it is also called, and conformed to receive corresponding first and second mounting members in angular relation.

Accordingly, it is an object of the present invention to provide a musical instrument, more particularly a cajon, having a resonant chamber with at least one snare assembly releasably secured inside the chamber.

It is another object of the present invention to provide a musical instrument, more particularly a cajon, having at least one snare assembly installed inside the resonant chamber with snare wires disposed vertically in continuous contact engagement with the inside surface of the panel member.

Still another object of the present invention is to provide a musical instrument, more particularly a cajon, with the means to produce a significantly clearer and more concise snare sound coupled with a resonant bass tone.

Another object of the present invention is to provide a musical instrument, more particularly a cajon, having the means to cause the snare wires mounted inside the resonant chamber to maintain a constant and generally equalizing force from top to bottom against the inside surface of the panel member.

It is yet another object of the present invention to provide a musical instrument, more particularly a cajon, with the means to isolate the snare sound from the bass sound.

Still another object of the present invention is to provide a musical instrument, more particularly a cajon, with the means to enable the fine tuning of the snares to accommodate a particular style of music.

Yet another object of the present invention is to provide a musical instrument, more particularly a cajon, with the means to achieve the proper balance of bass-to-snare ratio.

Still another object of the present invention is to provide a musical instrument, more particularly a cajon, with the means to modulate the sounds produced by the snares and, thus, reduce both the amount of deflection, i.e. back-and-forth motion, of the snare wires and the lingering of any undesirable sounds they may produce.

Yet another object of the present invention is to provide a musical instrument, more particularly a cajon, that is easy to play and cost effective to manufacture.

Still another object of the present invention is to provide a musical instrument, more particularly a cajon, with the means to expedite the removal of a snare assembly from inside the resonant chamber for repair or replacement.

Yet another object of the present invention is to provide a musical instrument, more particularly a cajon, that is constructed of a plurality of components that are joined by glue or adhesive.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1A:
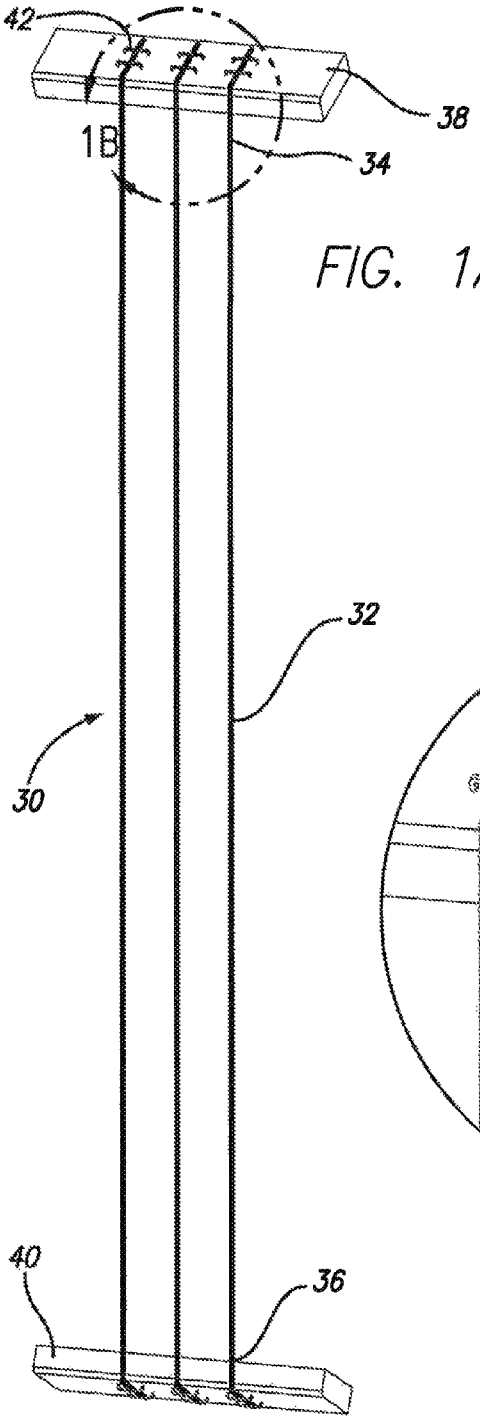
FIG. 1A is a perspective view of a snare assembly in accordance with the present invention.

The present invention provides a musical instrument, preferably cajon 10, comprised of housing 12 having resonant chamber 14 constructed from a plurality of panel members 16*a*-16*f* with each of the aforesaid panel members having an outside surface 18*a*-18*f* and inside surface 22*a*-22*f*, respectively, and secured by strong glue 15 or adhesive, or any other suitable non-metallic attachment means. Panel member 16*a*, usually the front panel of cajon 10, serves as strike plate 20 for producing the musical sounds. Also provided is at least one snare assembly 30 having a plurality of individual wires 32, typically a group of three, with each wire 32 including first end portion 34 and second end portion 36. Included as well are first mounting member 38 with front surface 38*a* and upper surface 38*b* to which first end portion 34 of each wire 32 is attached and second mounting member 40 with front surface 40*a* and lower surface 40*b* to which second end portion 36 of each wire 32 is attached. Each wire 32 may also be attached to certain other areas of first mounting member 38 and second mounting member 40, as may be appropriate. However, the attachment means for wires 32 should not be permitted to make direct contact with any of inside surfaces 22*a*-22*f* in order to avoid undesirable distortion in the snare sounds when cajon 10 is played. Staples 42 are the preferred attachment means, though screws and nails (not shown) may be suitable for this purpose under the appropriate circumstances. Mounting members 38 and 40 are generally rectangular in shape, though any appropriate configuration may be suitable.

First mounting member 38 is releasably supported inside resonant chamber 14 at or adjacent to first position 50 and second mounting member 40 is releasably supported inside resonant chamber 14 at or adjacent to second position 52. First mounting member 38 and second mounting member 40, when releasably supported inside resonant chamber 14, as described, act cooperatively to vertically stretch and maintain individual wires 32 in a substantially taut and continuous contact relationship with inside surface 22*a* of panel member 16*a*.

Figure 1B:
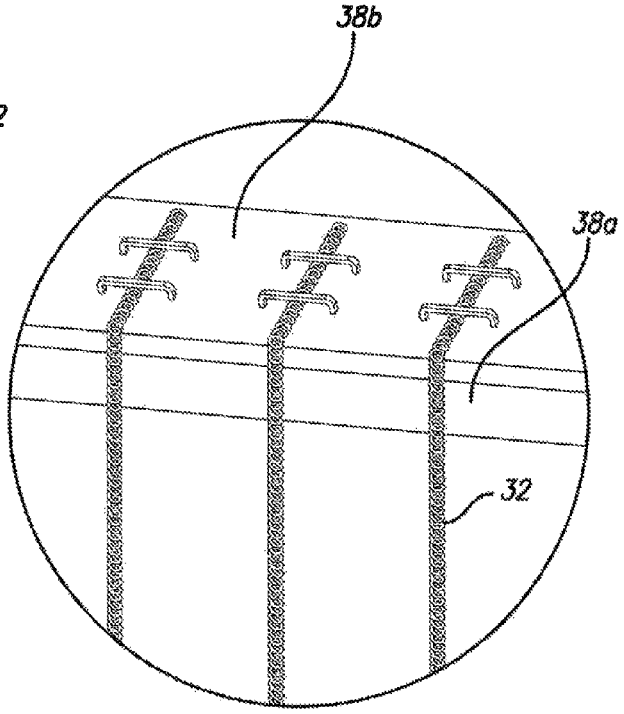
FIG. 1B is an enlarged perspective view of a section of the snare assembly in accordance with the present invention shown encircled by line 1B of FIG. 1A.
Figure 2A:
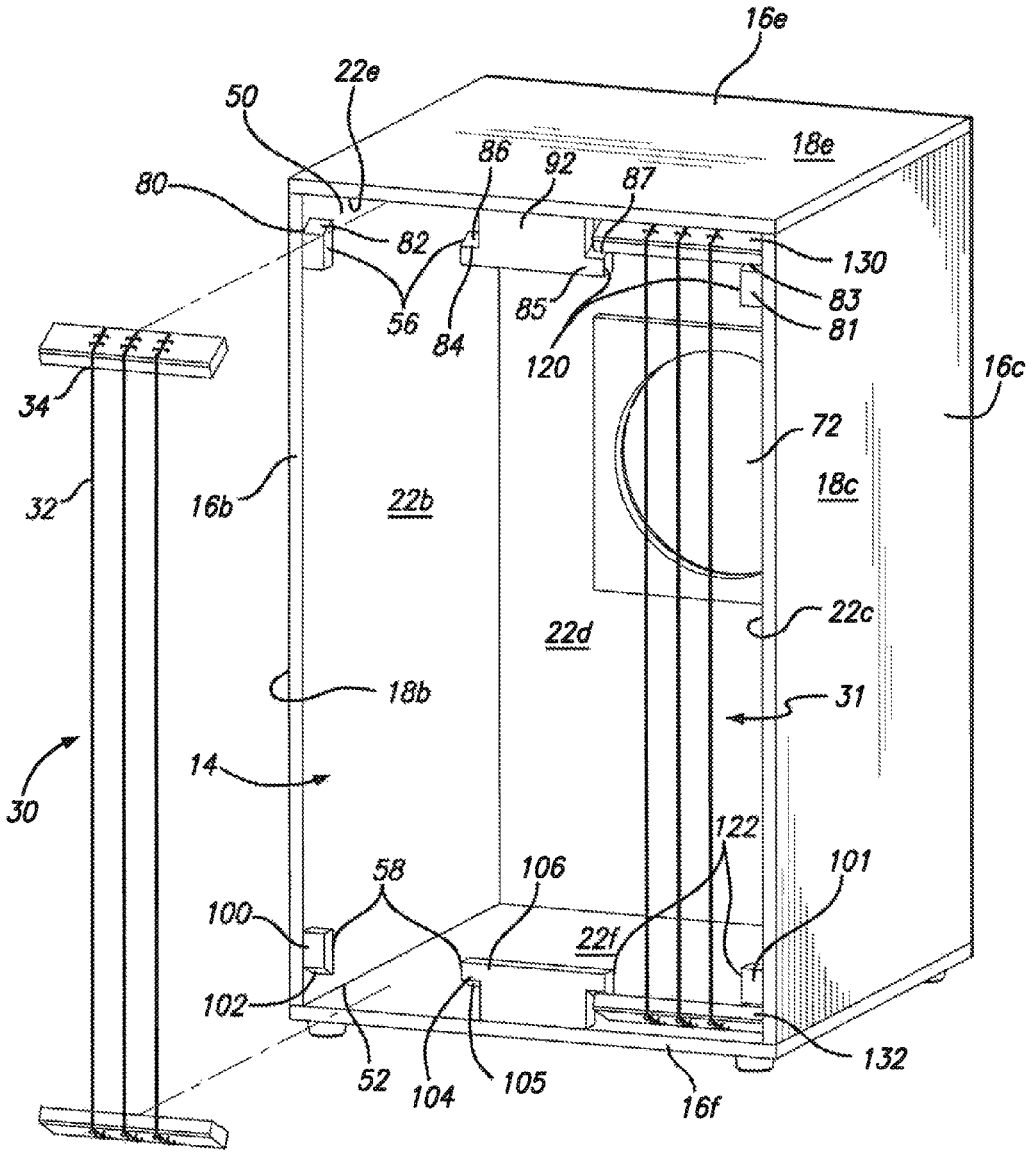
FIG. 2A is a front perspective view of the inside of the resonant chamber indicating the placement of the snare assembly in accordance with the present invention.
Figure 2B:
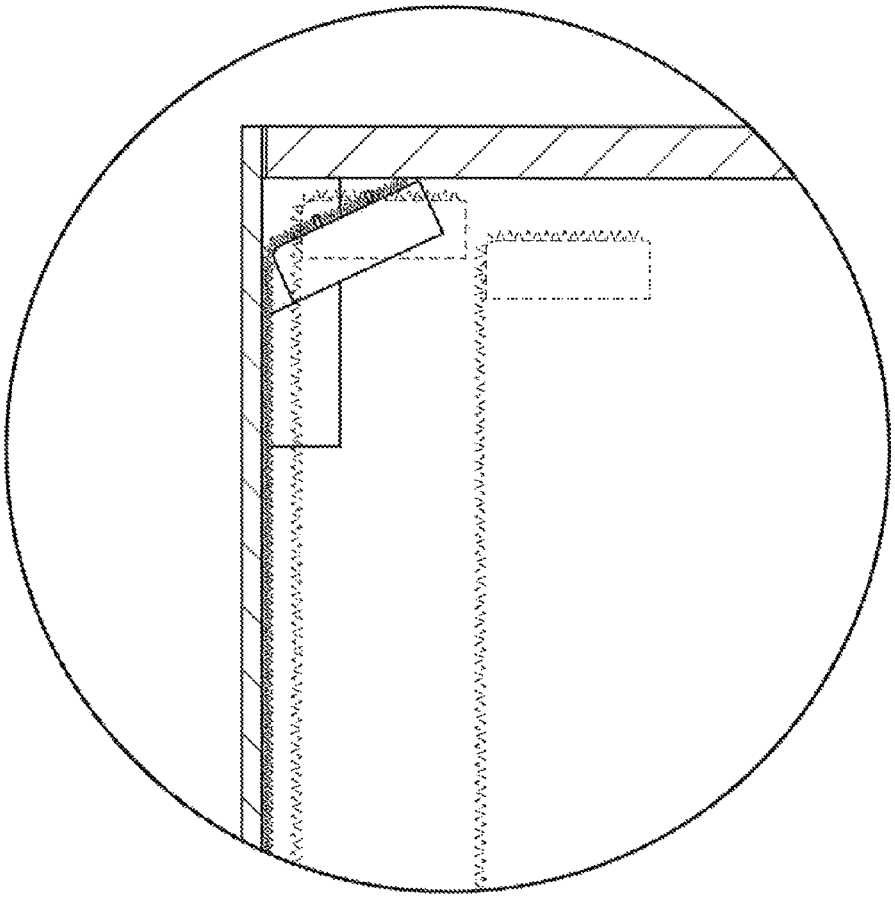
FIG. 2B is a cross-sectional view of the interior of the resonant chamber indicating the sequence of movements by the first mounting member in the process of its installation in accordance with the present invention.
Figure 2C:
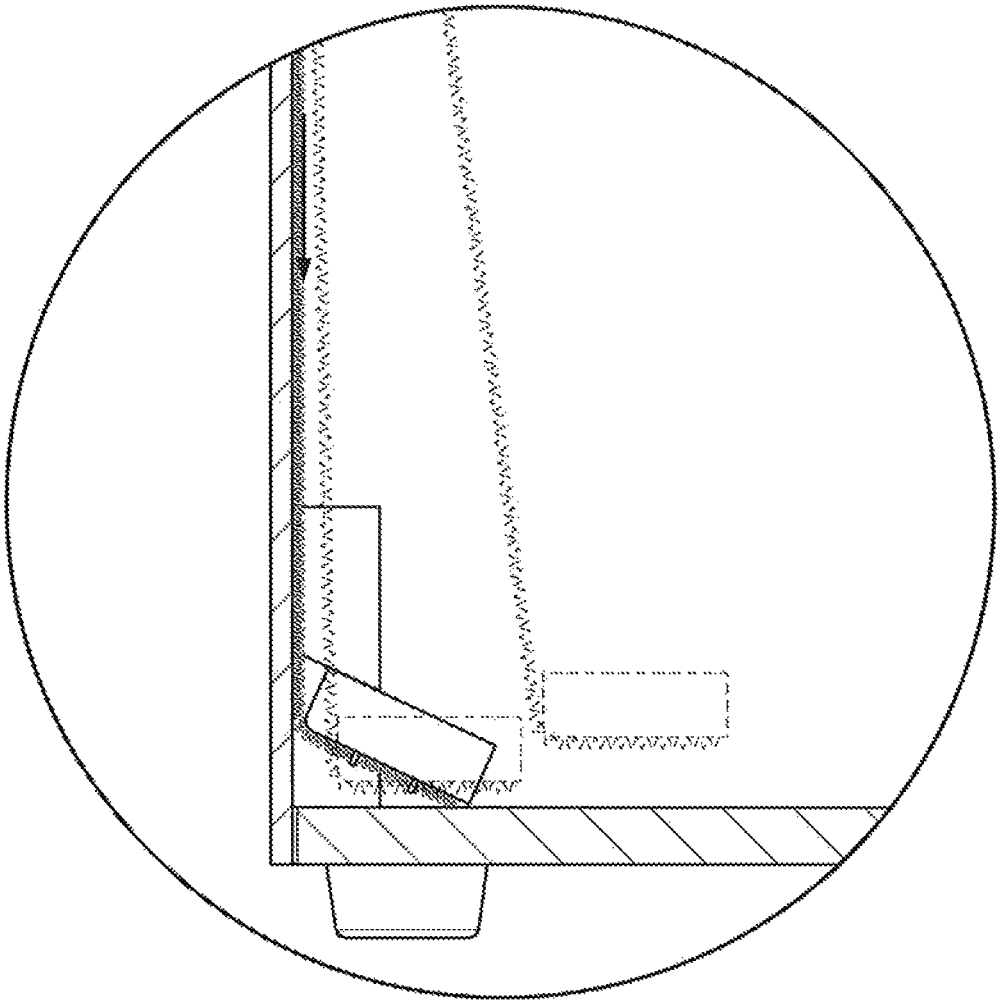
FIG. 2C is a cross-sectional view of the interior of the resonant chamber indicating the sequence of movements by the second mounting member in the process of its installation in accordance with the present invention.
Figure 3:
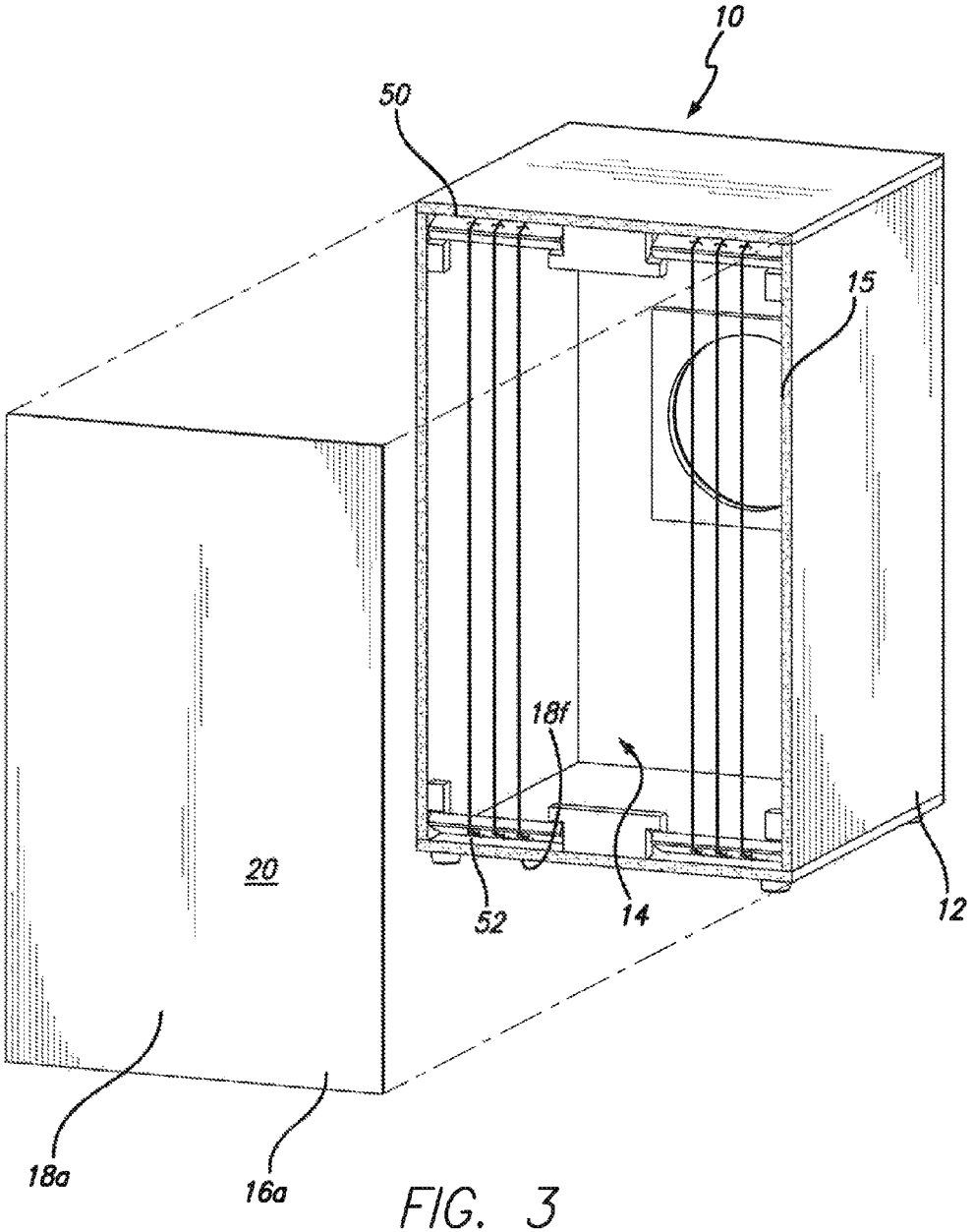
FIG. 3 is a front perspective view of the inside of the resonant chamber indicating the placement of the front panel (or strike plate) in accordance with the present invention.
Figure 4:
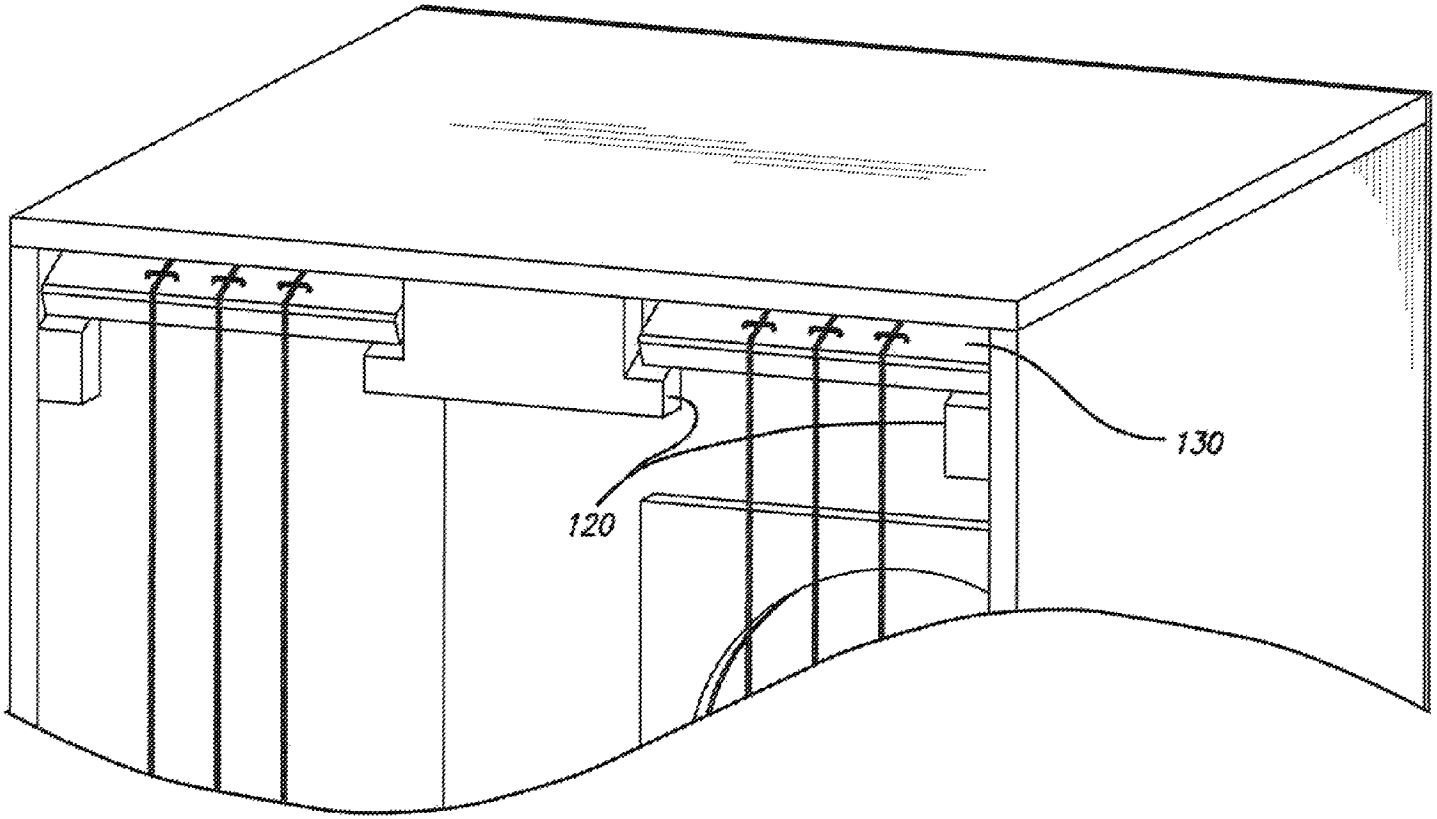
FIG. 4 is a perspective view of the first mounting members, respectively, for the two snare assemblies shown installed inside the top section of the resonant chamber in accordance with the present invention.
Figure 5:
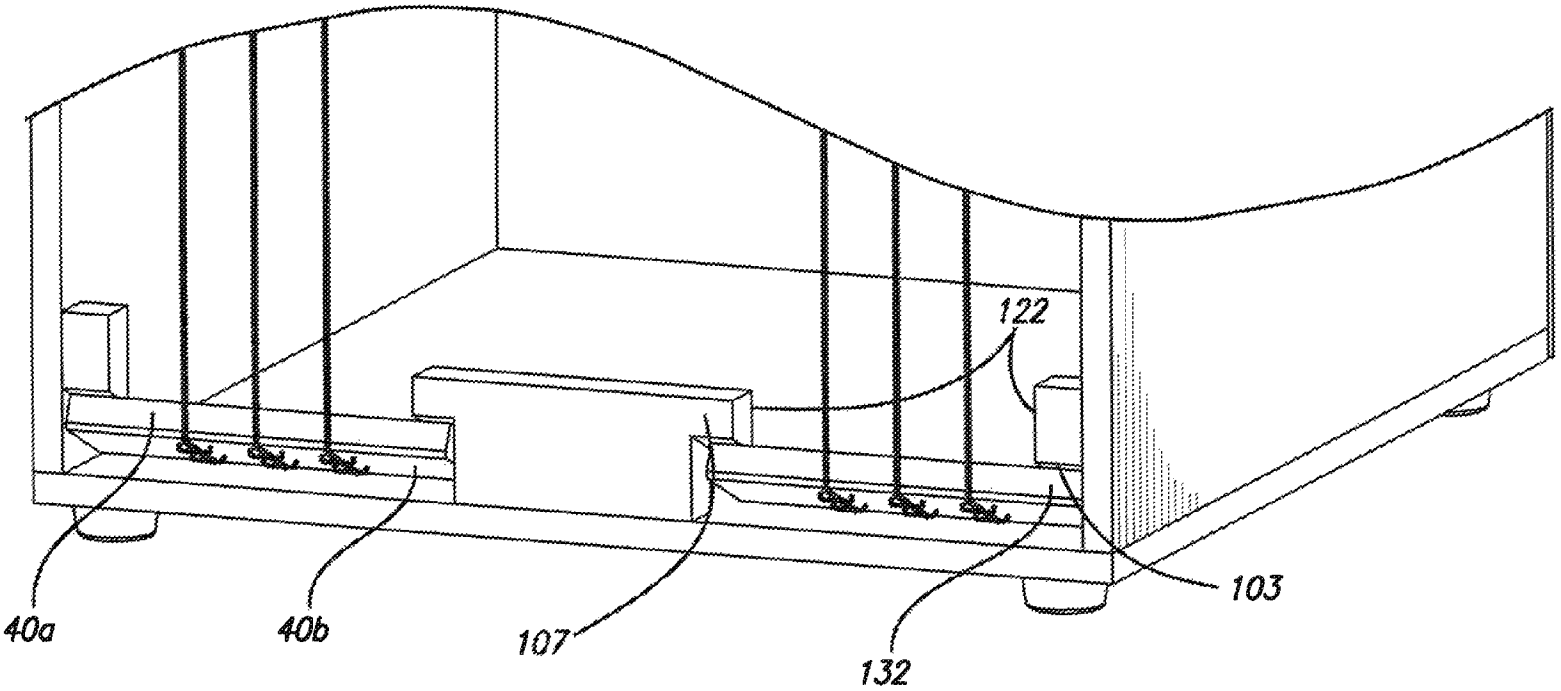
FIG. 5 is a perspective view of the second mounting members, respectively, for the two snare assemblies shown installed inside the bottom section of the resonant chamber in accordance with the present invention.
Figure 6A:
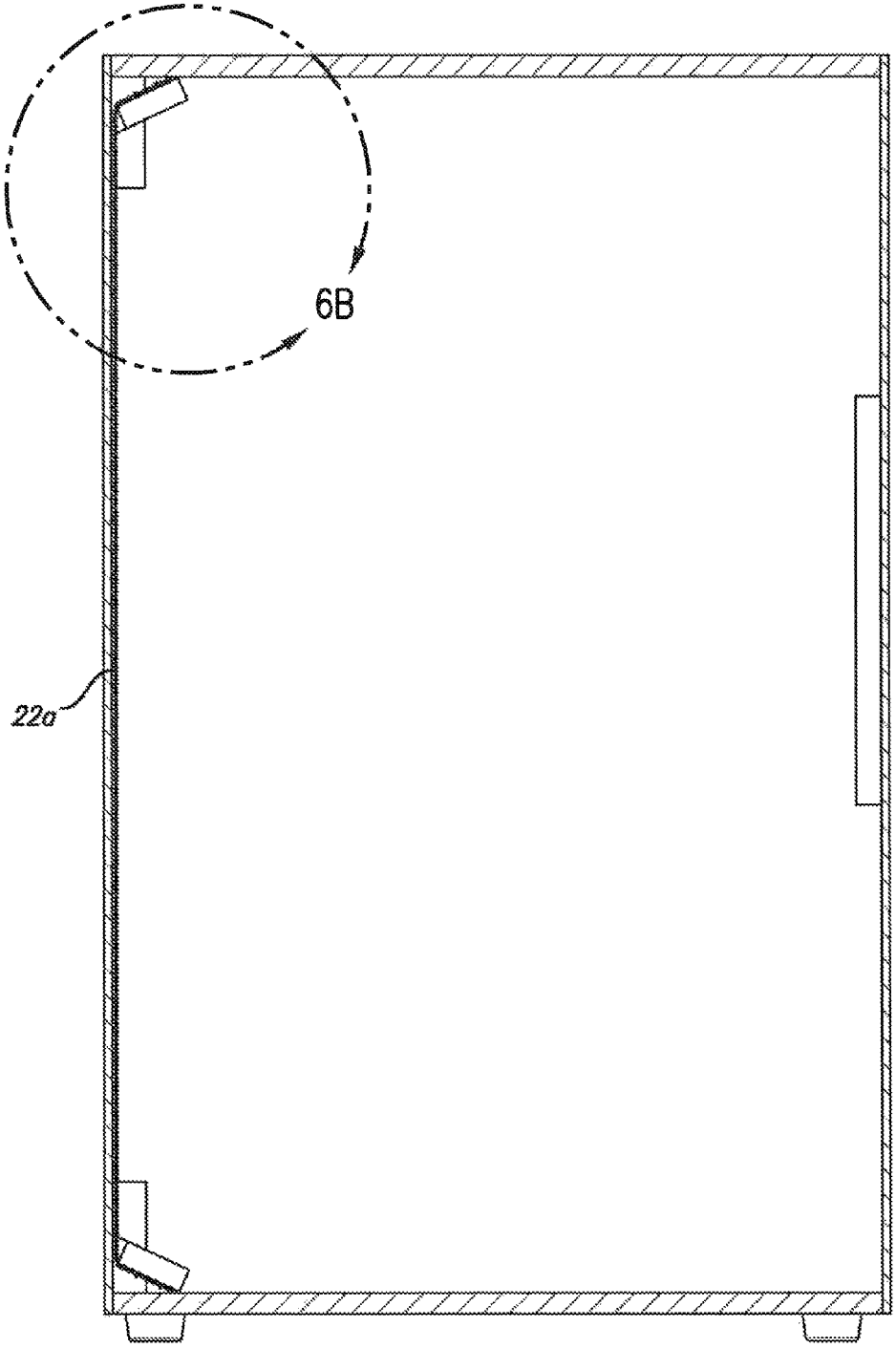
FIG. 6A is a cross-sectional view of the resonant chamber with one snare assembly shown installed inside in accordance with the present invention.
Figure 6B:
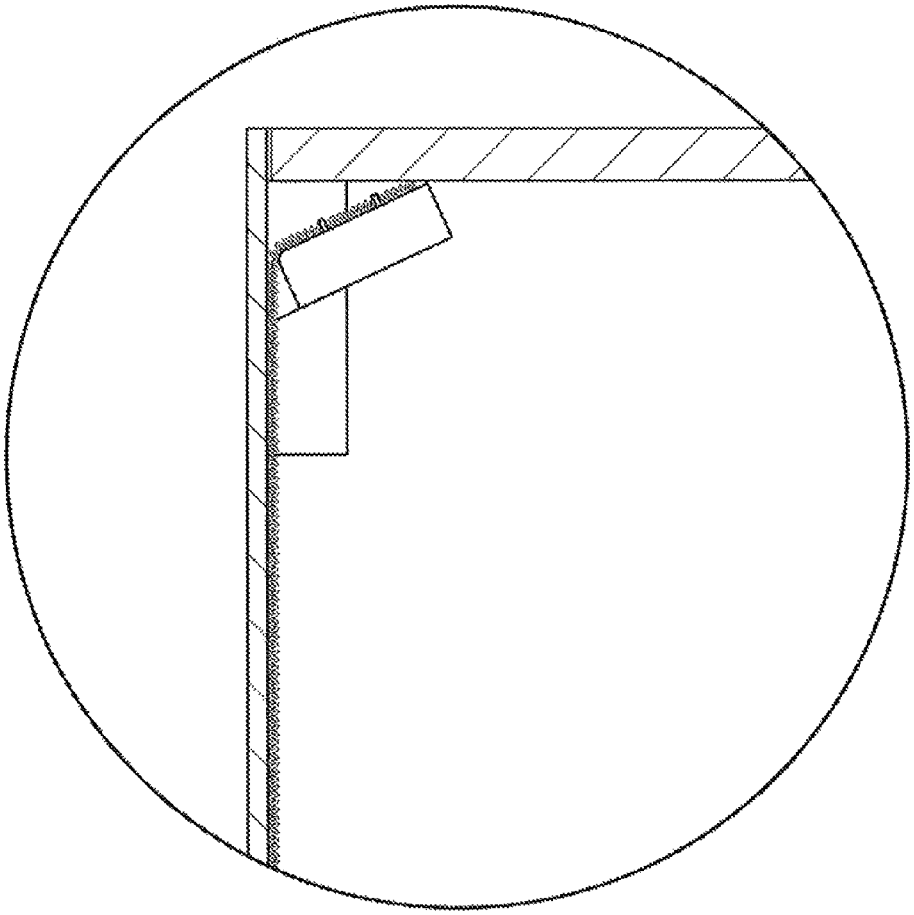
FIG. 6B is an enlarged perspective view of a cross-section of the snare assembly in accordance with the present invention shown encircled by line 6B of FIG. 6A.
Figure 7:
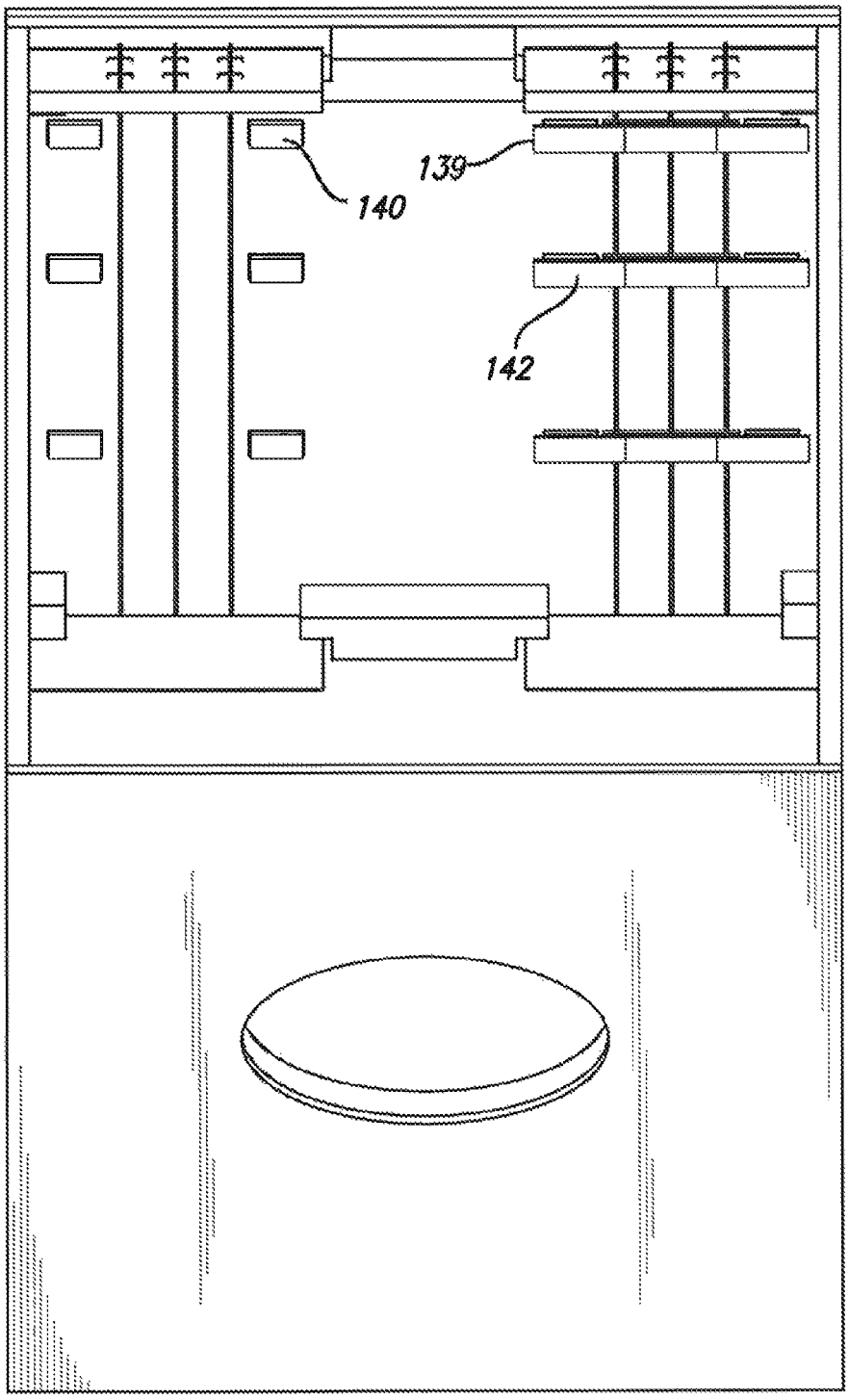
FIG. 7 is a top perspective view of the interior of the resonant chamber shown with the means to control snare deflection in accordance with the present invention.
Figure 8:
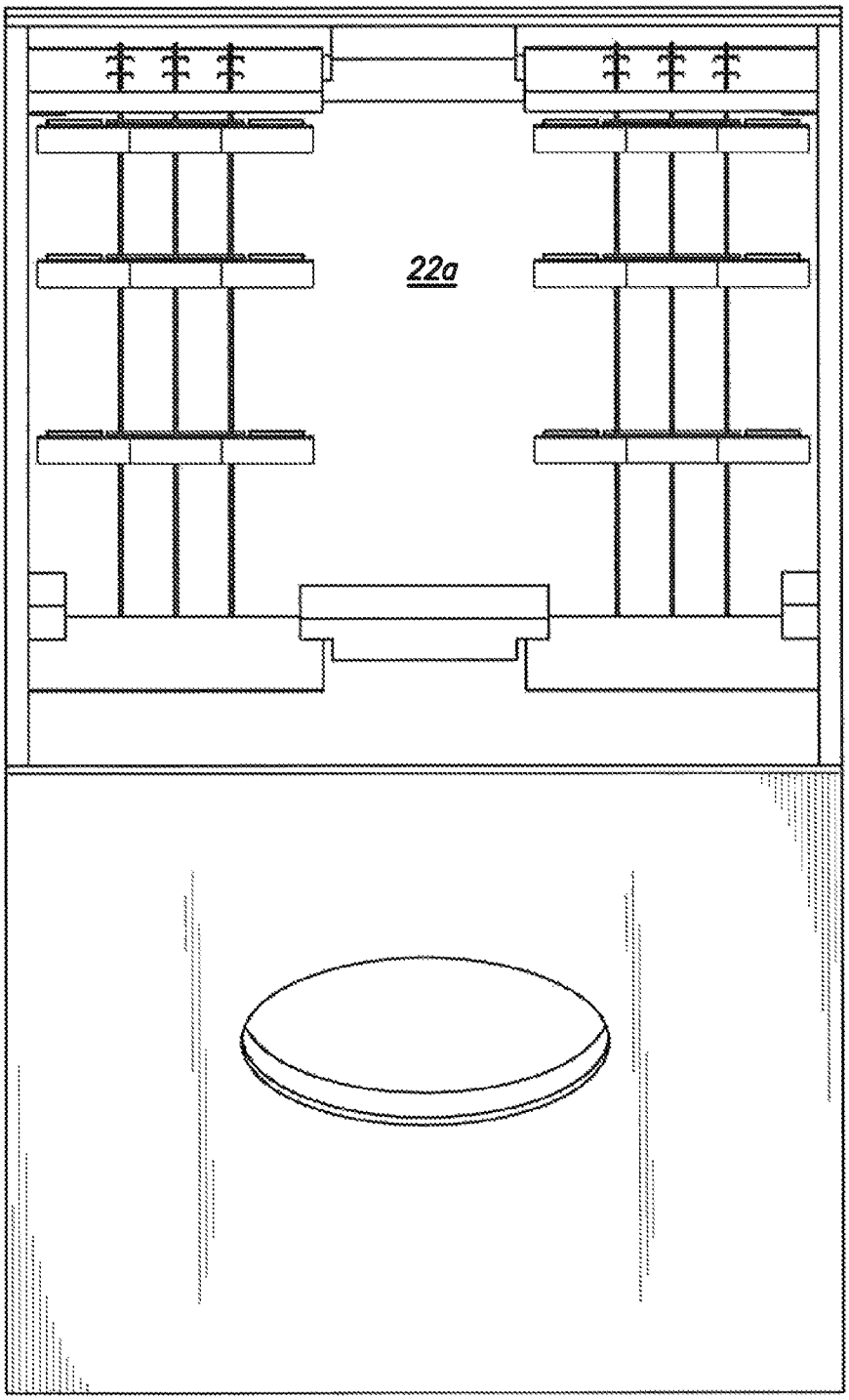
FIG. 8 is a top perspective view of the interior of the resonant chamber shown with the means to control snare deflection in accordance with the present invention.
Figure 9A:
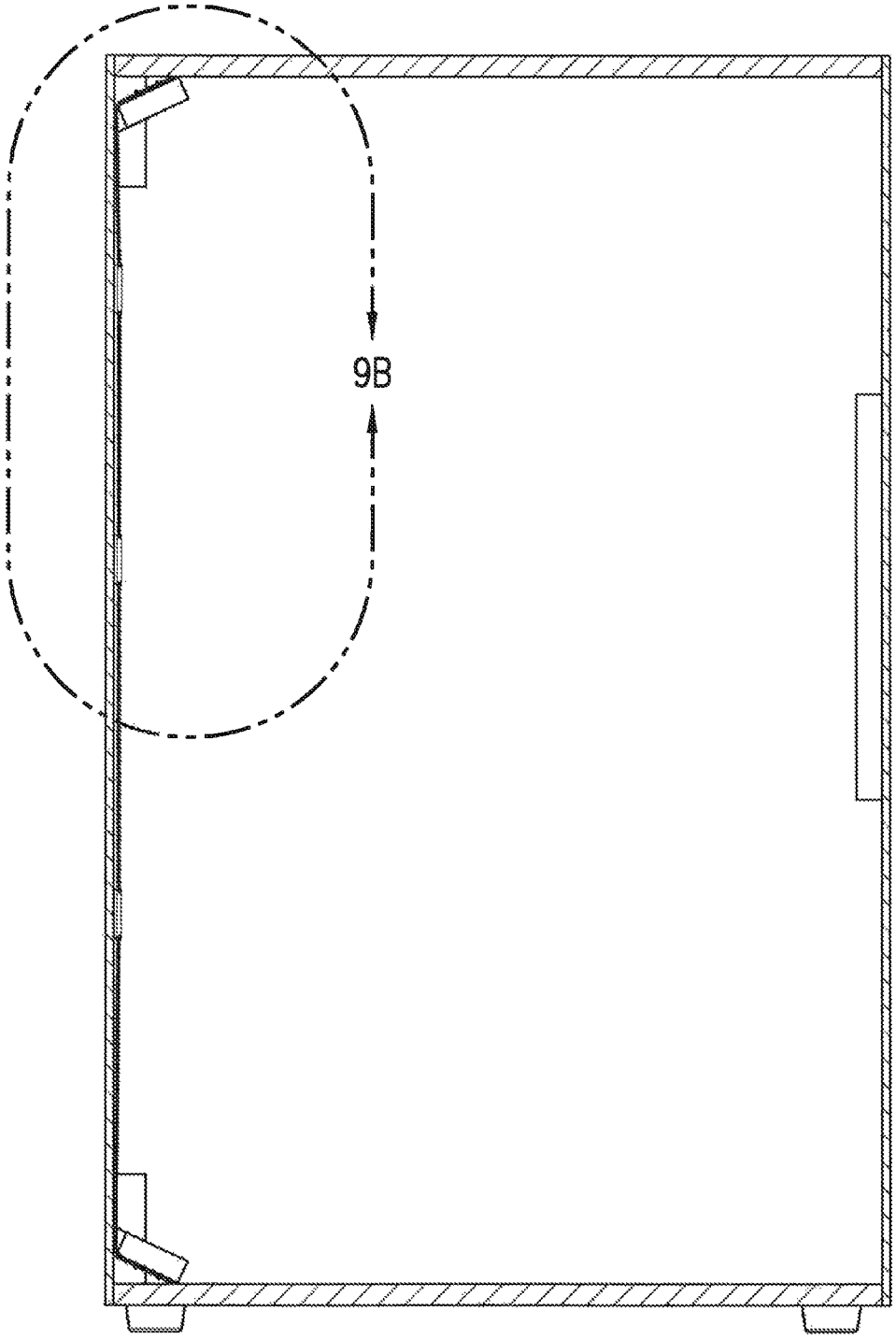
FIG. 9A is a cross-sectional view of the resonant chamber, including one snare assembly shown installed inside with the means to control snare deflection, in accordance with the present invention.
Figure 9B:
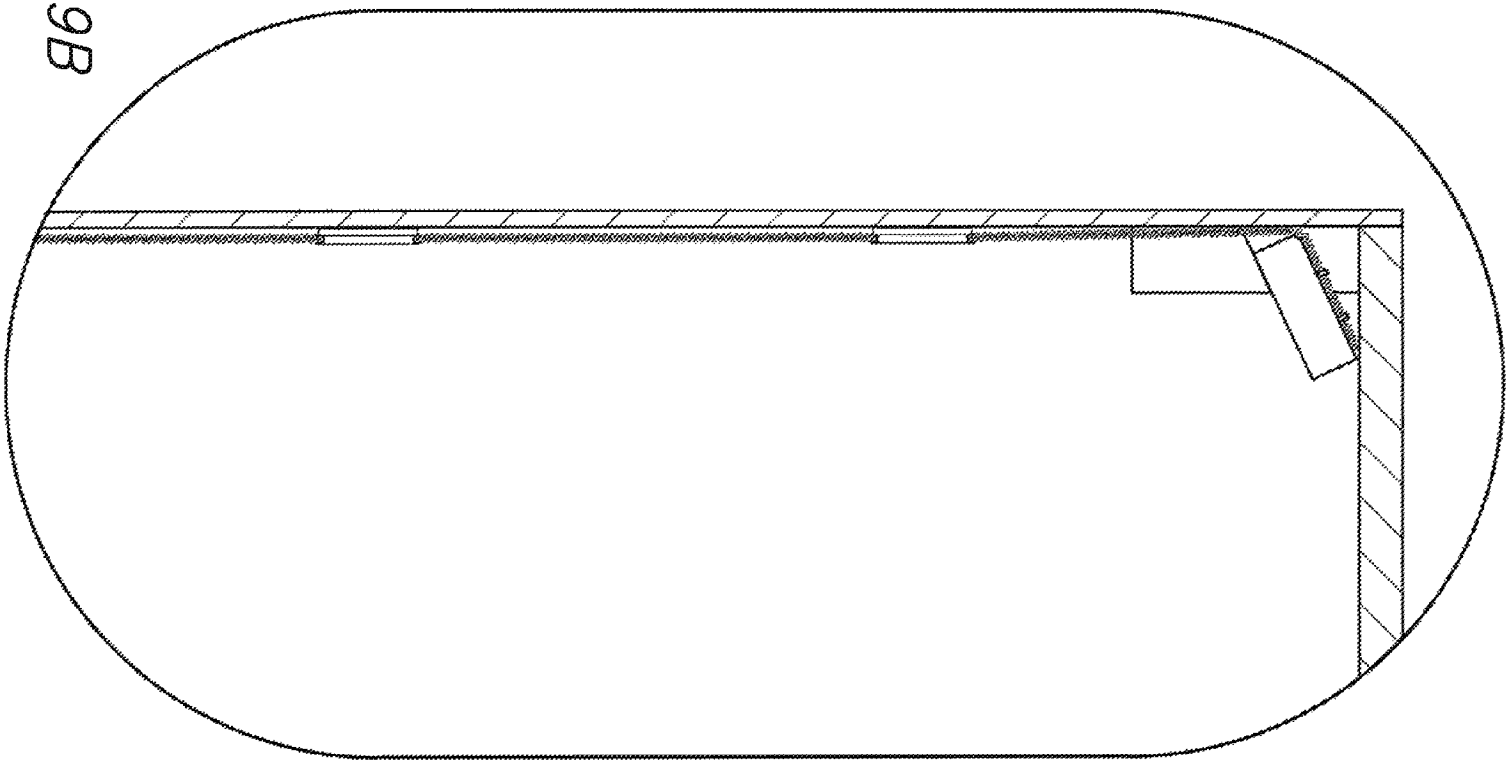
FIG. 9B is an enlarged cross-sectional view of the portion of a snare assembly as shown encircled by line 9B of FIG. 9A in accordance with the present invention.
Figure 10:
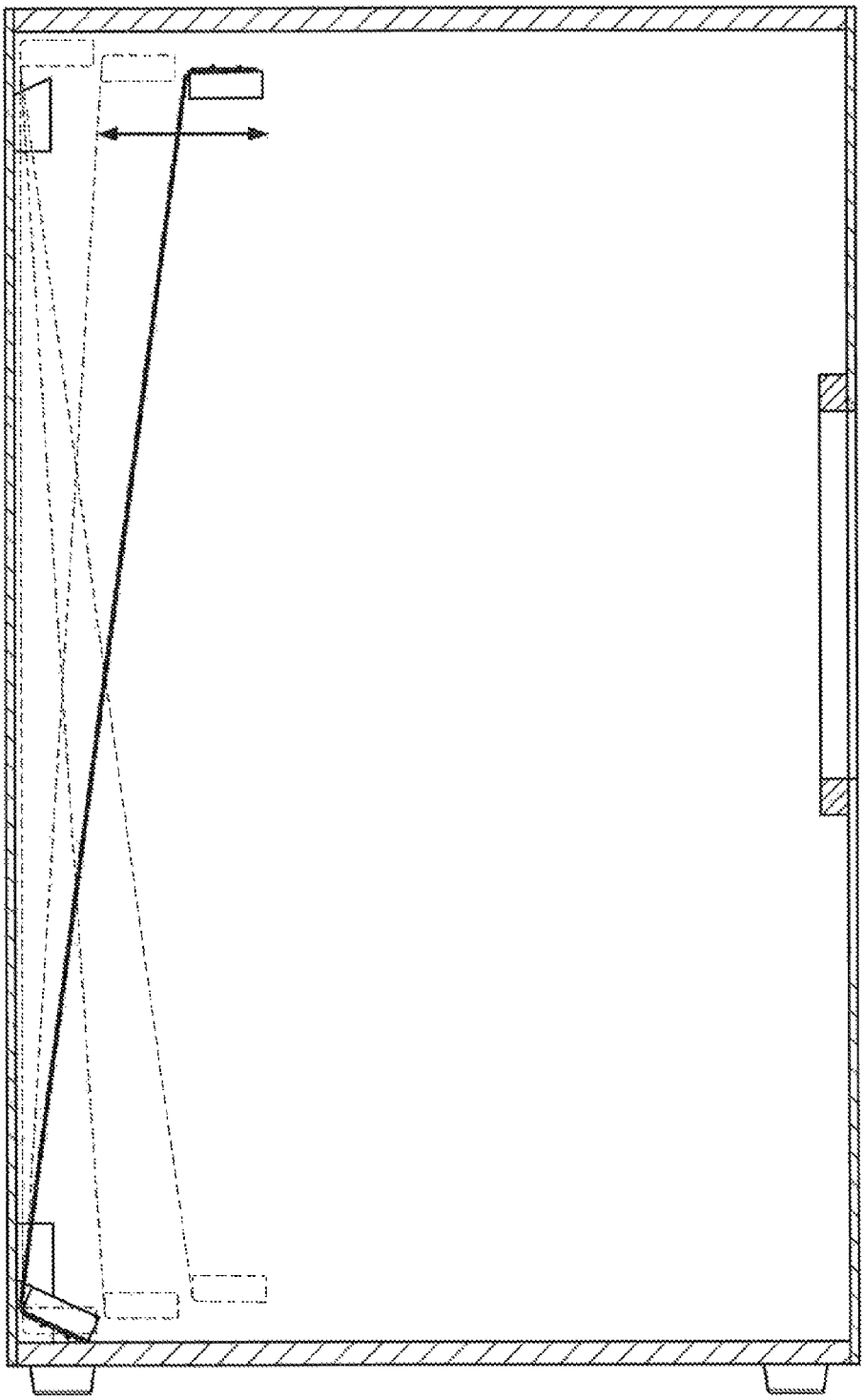
FIG. 10 is a cross-sectional view of the interior of the resonant chamber indicating the sequence of movements by a snare assembly in the process of its removal in accordance with the present invention.
Figure 11:
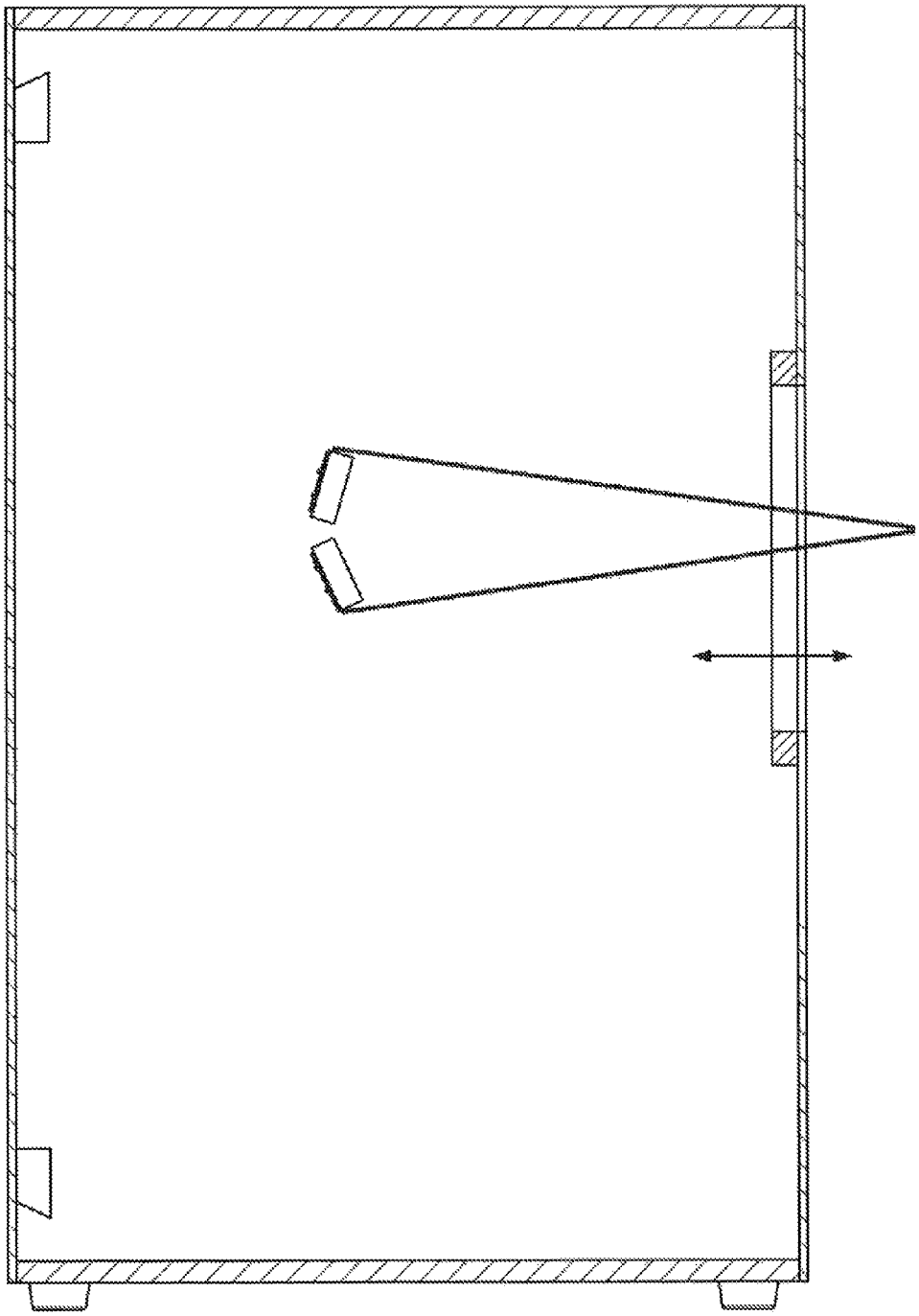
FIG. 11 is a cross-sectional view of the interior of the resonant chamber indicating the movement of a snare assembly in the process of its removal through the rear vent opening in accordance with the present invention.
Figure 12:
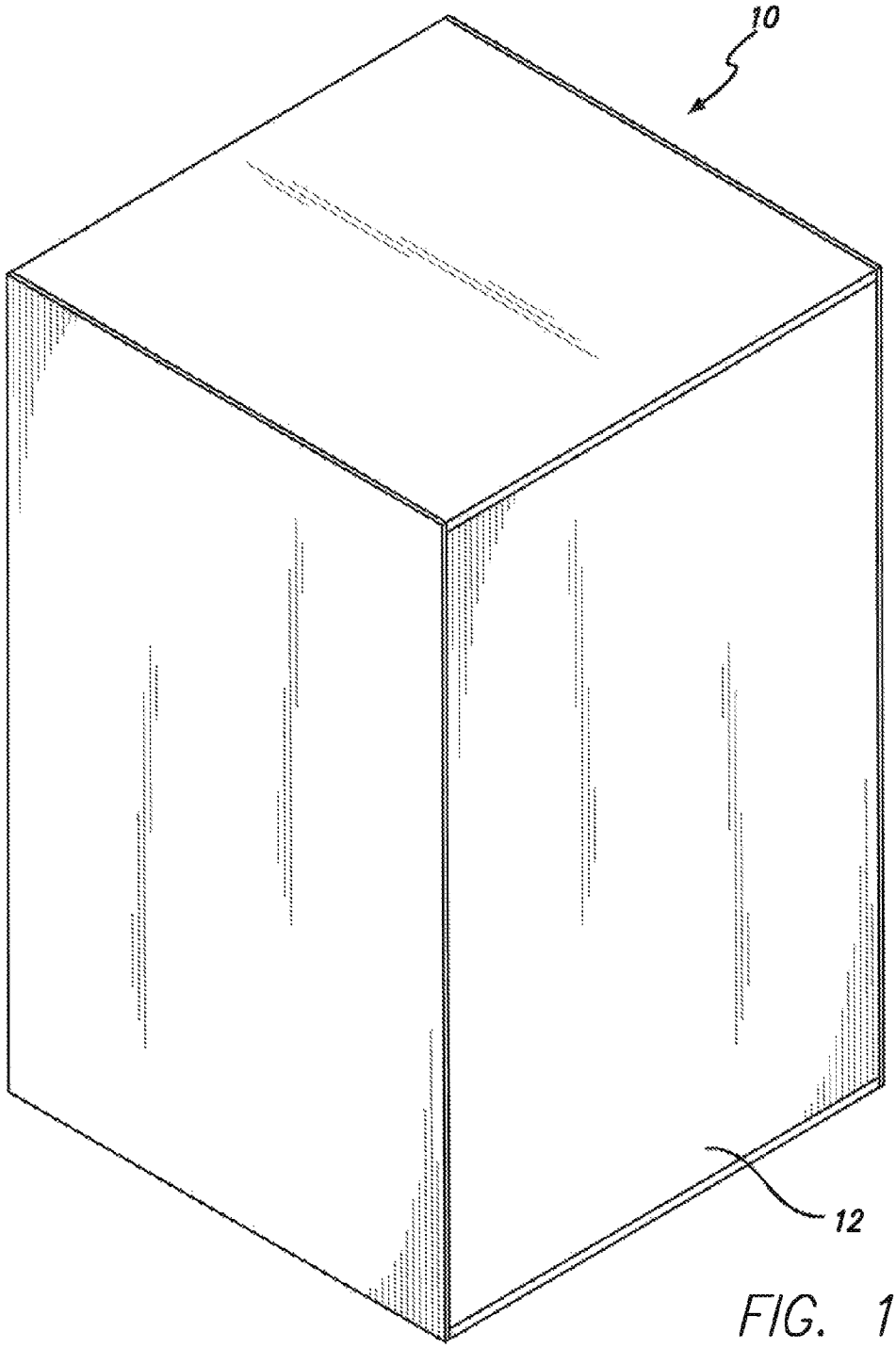
FIG. 12 is a front perspective view of cajon in accordance with the present invention.
Figure 13:
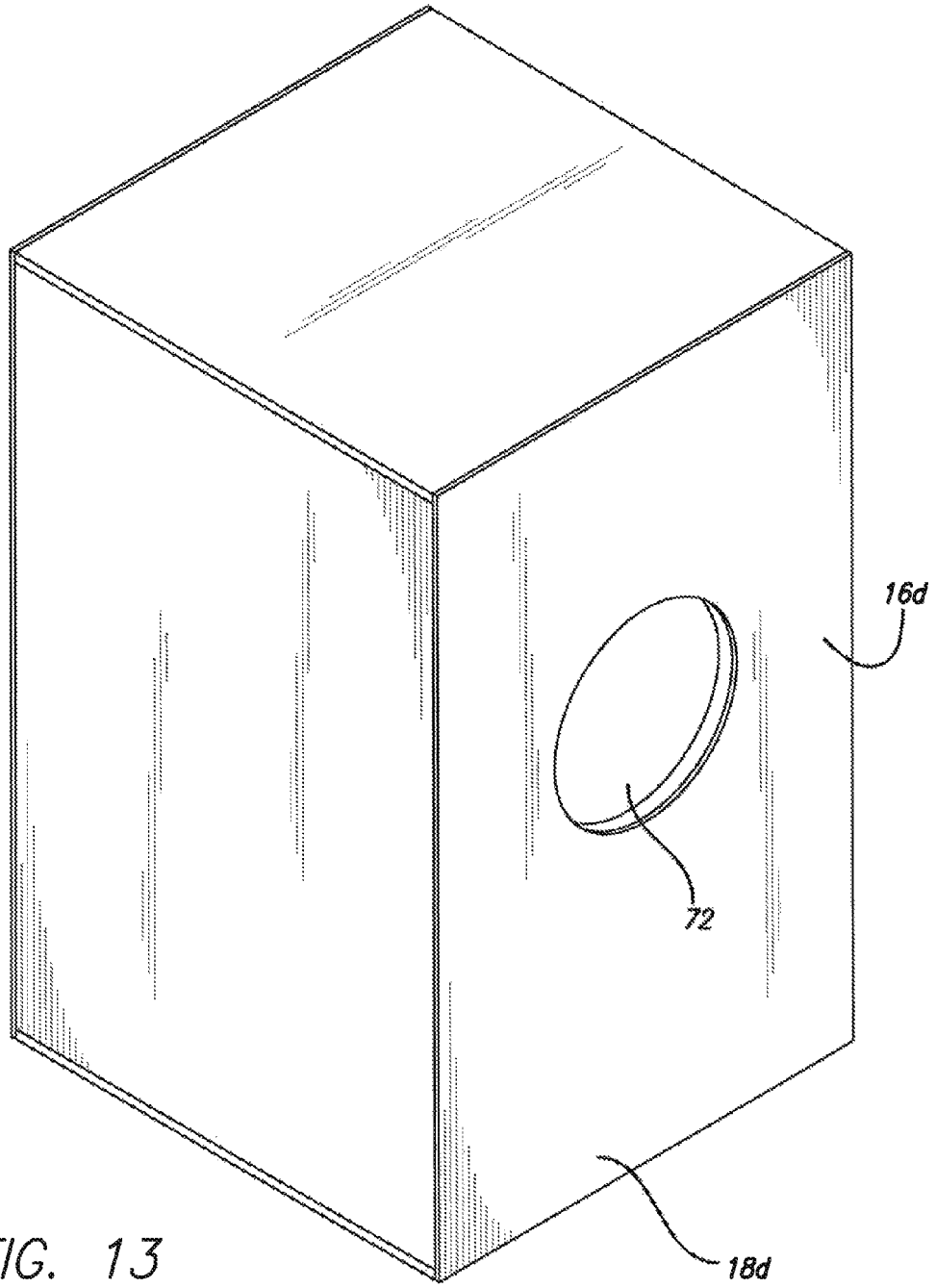
FIG. 13 is a rear perspective view of a cajon shown with a vent opening formed in the back panel in accordance with the present invention.
Figure 14:
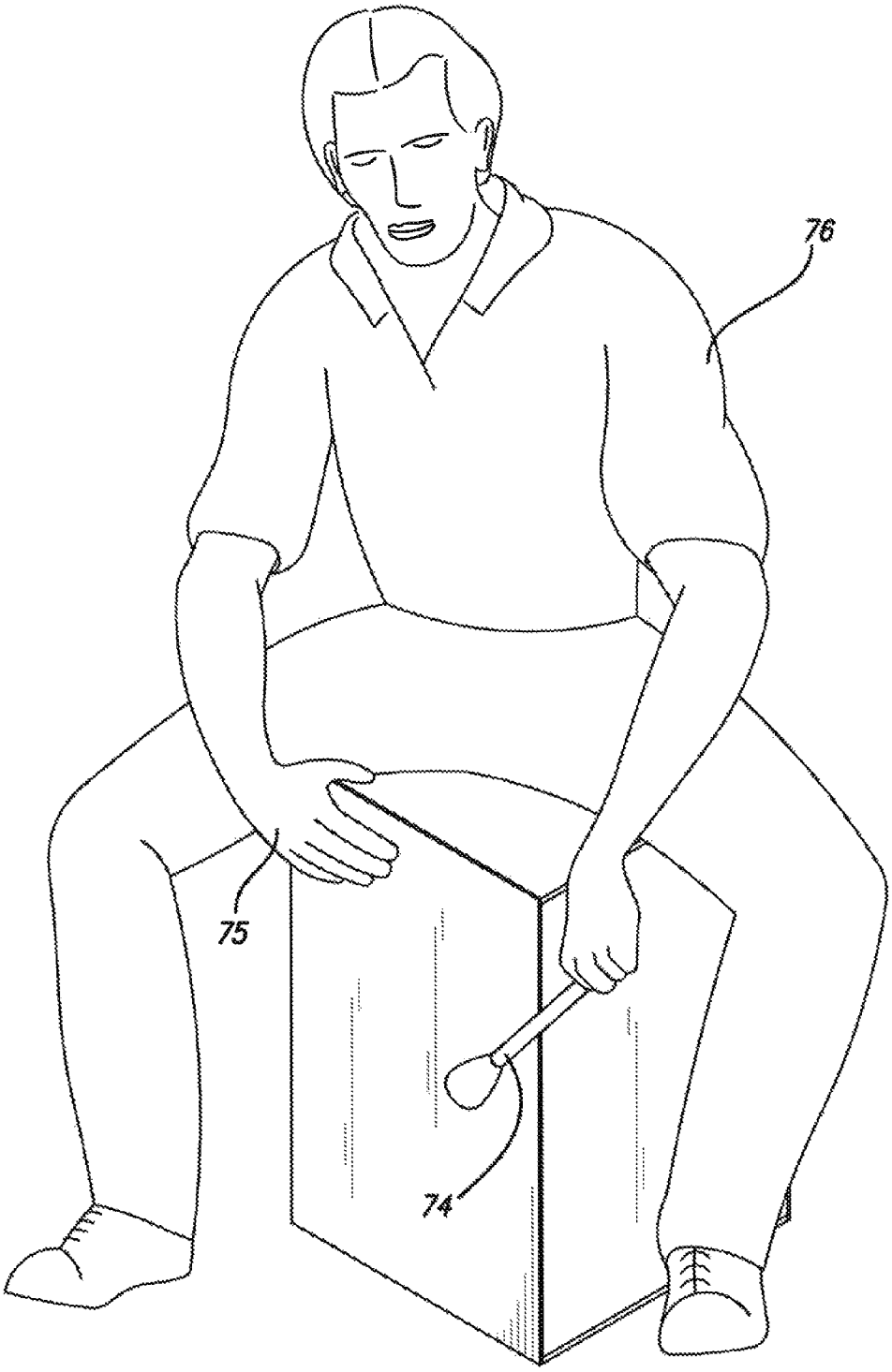
FIG. 14 is a perspective view of a cajon with a player hitting the strike plate in accordance with the present invention.

Panel members 16*a*-16*f* and first and second mounting members 38 and 40, respectively, may be fabricated of material from the group comprised of wood, wood composite, synthetics and metal alloy. Wires 32 may be fabricated of material from the group comprised of wire strands, animal or synthetic gut line or cord, and solid, twisted or braided metal cable. However, the preferred embodiment of the present invention includes wire 32, either coiled or helically wound, as shown in detail in FIG. 1B.

Inside resonant chamber 14 are first generally wedge-shaped support member 56, which is secured nearby or adjacent to first position 50, and second generally wedge-shaped support member 58, which is secured nearby or adjacent to second position 52. First generally wedge-shaped support member 56 and second generally wedge-shaped support member 58 are spaced-apart and have sloping surfaces disposed in the direction of inside surface 22*a* of panel member 16*a* and are conformed to receive corresponding first mounting member 38 and second mounting member 40 in angular relation, as described below.

In its preferred configuration, first generally wedge-shaped support member 56 is comprised of first guide member 80 with upwardly facing sloped surface 82 and a second guide member 84 with upwardly facing sloped surface 86. First guide member 80 is secured inside resonant chamber 14, preferably by attachment to inside surface 22*b* of side panel 16*b*, using a strong glue 15 or adhesive or any other suitable attachment means for this purpose, while second guide member 84 is integrated into centrally-positioned first guide support member 92, which is also secured inside resonant chamber 14, preferably by attachment to inside surface 22*e* of top panel member 16*e* in the same manner. Similarly, second generally wedge-shaped support member 58 is comprised of first guide member 100 with downwardly facing sloped surface 102, which is secured inside resonant chamber 14, preferably by attachment to inside surface 22*b* of side panel member 16*b*, using strong glue 15 or adhesive, or any other suitable attachment means for this purpose, and second guide member 104 with downwardly facing sloped surface 105 is integrated into centrally-positioned second guide support member 106, which is likewise secured inside resonant chamber 14, again preferably by attachment to inside surface 22*f* of bottom panel 16*f* in the same manner.

Third generally wedge-shaped support member 120 is comprised of first guide member 81 with upwardly facing sloped surface 83 and second guide member 85 with upwardly facing sloped surface 87 integrated into centrally-positioned third guide support member 92. First guide member 81 is secure inside resonant chamber 14, preferably by attachment to inside surface 22*c* of panel member 16*c* and third guide support member 92 is also secured inside resonant chamber 14, again preferably by attachment to inside surface 22*e* of panel member 16*e*, using a strong glue 15 or adhesive, or any other suitable attachment means for this purpose. Fourth generally wedge-shaped support member 122 is comprised of first guide member 101 with downwardly facing sloped surface 103 and second guide member 107 integrated into centrally-positioned fourth guide support member 106. First guide member 101 is secured inside chamber 14, preferably by attachment to inside surface 22*c* of panel member 16*c*, and fourth guide support member 106 are similarly secured to positions inside resonant chamber 14 in the same manner as their counterparts, as described.

Snare assembly 31, which is normally identical to snare assembly 30, though more specifically first mounting member 130 and second mounting member 132, engages the components of spaced-apart third generally wedge-shaped support member 120 and fourth generally wedge-shaped support member 122, respectively, in the same manner as their counterparts alongside to achieve the same purpose.

Formed within rear panel member 16*d* is vent opening 72 to enable the production of bass sounds when strike plate 20 is struck by any hard object, such as mallet 74, or a stick (not shown) or hand 75 of player 76. Vent opening 72 also provides easy and convenient access to resonant chamber 14 for identifying and then removing or replacing any snare assembly constructed in accordance with the present invention that is in need of repair or replacement.

In practice, snare assembly 30 is installed inside resonant chamber 14 by the concurrent placement of first mounting member 38 upon sloped surface 82 of first guide member 80 and sloped surface 86 of second guide member 84. Coiled wires 32, which are initially compressed, are stretched appropriately and pulled downward to enable second mounting member 40 to be similarly placed upon second generally wedge-shaped support member 58, specifically upon sloped surface 102 of first guide member 100 and sloped surface 105 of second guide member 104. With coiled wires 32 under sufficient tension once snare assembly 30 is fully mounted, first support member 38 and second support member 40 are moved forward, as necessary, against inside surface 22*a* with sufficient pressure to ensure that coiled wires 32 maintain uniform positive contact against inside surface 22*a* generally from top to bottom.

Sounds emanating from wires 32 may be controlled or modified to produce the higher frequency snare sounds or lower frequency bass sounds, or a combination of the two, as desired, by essentially overlaying the back portions of wires 32 with a plurality of fasteners 139 consisting of hook 140 and loop 142 components, which are more commonly known by the trademark VELCRO®. More specifically, hook 140 may be attached to inside surface 22*a* to either side of wires 32 to ensure that wires 32 maintain throughout their contact with inside surface 22*a*, while loop 142 actually overlays the back of wires 32. Hook 140 and loop 142 are then brought together and secured as fastener 139 to modulate or even minimize the degree of deflection, both physical in terms of the vacillating back-and-forth motion of wires 32 upon the striking of strike plate 20, and sound, which sometimes tends to linger if not dampened sufficiently (FIGS. 7-9B). One or more fasteners 139 may be utilized with any single snare assembly depending upon the degree of the dampening effect, modulation, the targeted area for the modulation, or higher or lower frequencies desired. For example, if the intent is to modulate the snare sounds originating from the upper and lower regions of resonant chamber 14, then fasteners 139 may be caused to overlay snare wires 32 only at those positions, leaving the mid-section of wires 32 unfettered.

The removal of snare assemblies 30 and 31 may be achieved in one manner by simply reaching hand 75 inside resonant chamber 14 through vent opening 72 and lifting upon first mounting member 38 and pulling it backwards. This eases the tension in wires 32 and allows second mounting member 40 to drop down and disengage. This sequence may also be reversed as an alternative means to achieve the same objective. Mounting members 38 and 40 may then be pulled out from inside resonant chamber 14 out through opening 72.

In another embodiment of the present invention, first and second mounting member 38 and 40 may be positioned upon support members (not shown) configured differently than the wedge-shaped support members already described, for example, square or rectangular shaped, with surfaces generally level, not sloped.

While the invention will be described in connection with a certain preferred embodiment, it is understood that it is not intended to limit the invention to that embodiment. Rather, it is intended to cover all alternatives, modifications and equivalents as may be included within the spirit and scope of the invention as defined by the appended claims.

The invention claimed is:

1. A musical instrument, comprising:

a housing having a resonant chamber fashioned from a plurality of panel members, each of said panel members having a corresponding inside surface and outside surface;

at least one snare assembly, said snare assembly having a plurality of individual wires, not directly connected to any of said panel members, said individual wires having a first end portion and a second end portion, and a first mounting member formed independently of any of said panel members to which said first end portion is attached and a second mounting member formed independently of any of said panel members to which said second end portion is attached, said first mounting member being slidably engaged at a first position inside said resonant chamber and said second mounting member being slidably engaged at a second position inside said resonant chamber, wherein a first generally wedge-shaped support member is secured at said first position and a second generally wedge-shaped support member is secured at said second position, said first and second wedge-shaped support members being spaced-apart and having sloping surfaces disposed towards said inside surface of at least one of said panel members, said sloping surfaces conformed to receive corresponding said first and second mounting members in angular relation, said first mounting member and said second mounting member being disposed cooperatively to vertically stretch said individual wires substantially taut in continuous contact relation with said inside surface.

2. The musical instrument of claim 1 wherein said first mounting member and said second mounting member are generally rectangular in shape.

3. The musical instrument of claim 2 wherein said first mounting member and said second mounting member are fabricated of material from the group comprising wood, wood composite, synthetics and metal alloy.

4. The musical instrument of claim 1 wherein said first mounting member is attached to said first end portion and said second mounting member is attached to said second end portion using means from the group comprised of staples, nails and screws.

5. The musical instrument of claim 4 wherein said staples, screws and nails are situated recessed from said inside surface of said panel member.

6. The musical instrument of claim 1 wherein said individual wires are fabricated of material from the group comprised of wire strands, animal or synthetic gut line or cord, and solid, twisted or braided metal cable.

7. The musical instrument of claim 1 wherein said individual wires are each coiled.

8. The musical instrument of claim 7 wherein the degree that said coiled wires impact against said inside surface of said panel member is directly relative to the tension in said coiled wires.

9. The musical instrument of claim 1 wherein said individual wires are each helically wound.

10. The musical instrument of claim 9 wherein the degree that said helically wound wires impact against said inside surface of said panel member is directly relative to the tension in said helically wound wires.

11. The musical instrument of claim 1 wherein said panel members are fabricated of material from the group comprised of wood, wood composites, fiberglass, synthetics and metal alloy.

12. The musical instrument of claim 1 wherein at least one of said panel members includes a vent opening.

13. The musical instrument of claim 1 wherein each said snare assembly is comprised of three individually coiled wires.

14. The musical instrument of claim 1 wherein each said snare assembly is comprised of three individually helically wound wires.

15. The musical instrument of claim 1 comprising one or more hook-and-loop fastener means disposed in contact relation with said individual wires to modulate the sounds produced by said individual wires.

16. The musical instrument of claim 15 wherein said hook portion of said fastener means is attached to said inside surface of said panel member on either side of said individual wires.

17. The musical instrument of claim 16 wherein said loop portion and said hook portion of said fastener means are joined to impose a dampening effect on the sound produced by said individual wires.

18. The musical instrument of claim 1 wherein said panel members are adhesively joined to construct said resonant housing.

19. The musical instrument of claim 1 wherein said panel members are joined by glue to construct said resonant housing.

20. The musical instrument of claim 1 wherein said first and second mounting members are individually removable from said spaced-apart generally wedge-shaped support members and retrievable from inside said resonant chamber through said vent opening.

21. The musical instrument of claim 1 comprising a first snare assembly and a second snare assembly spaced-apart and secured inside said resonant chamber.

22. The musical instrument of claim 1 wherein said plurality of individual wires are placed in parallel relation.

23. The musical instrument of claim 1 wherein said first mounting member has a front surface and an upper surface and said second mounting member has a front surface and a lower surface, said individual wires being attached to said upper surface of said first mounting member and said lower surface of said second mounting member.

24. A musical instrument, comprising:

a housing having a resonant chamber fashioned from a plurality of panel members, each of said panel members having a corresponding inside surface and outside surface;

at least one snare assembly, said snare assembly having a plurality of individual wires, said individual wires having a first end portion and a second end portion, and a first mounting member to which said first end portion is attached and a second mounting member to which said second end portion is attached, said first mounting member being releasably supported at a first position inside said resonant chamber and said second mounting member being releasably supported at a second position inside said resonant chamber, wherein a first generally wedge-shaped support member is secured at said first position and a second generally wedge-shaped support member is secured at said second position, said first and second wedge-shaped support members being spaced-apart and having sloping surfaces disposed towards said inside surface of at least one of said panel members, said sloping surfaces conformed to receive corresponding said first and said second mounting members in angular relation, said first and said second mounting members being disposed cooperatively to vertically stretch said individual wires substantially taut in continuous contact relation with said inside surface.

* * * * *